United States Patent [19]

Nissler

[11] Patent Number: 4,978,987

[45] Date of Patent: Dec. 18, 1990

[54] APPARATUS FOR DEVELOPMENT AND AFTER-TREATMENT OF PHOTOGRAPHIC MATERIAL TO BE DEVELOPED

[75] Inventor: Siegfried Nissler, Leinfelden-Echterdingen, Fed. Rep. of Germany

[73] Assignee: Autoplan Heimerdinger & Stabler GmbH & Co., Leinfelden-Echterdingen, Fed. Rep. of Germany

[21] Appl. No.: 399,228

[22] Filed: Aug. 28, 1989

[30] Foreign Application Priority Data

Aug. 27, 1988 [DE] Fed. Rep. of Germany ..... 8810863
Sep. 17, 1988 [DE] Fed. Rep. of Germany ..... 8811829

[51] Int. Cl.[5] ..... G03D 13/10
[52] U.S. Cl. ..... 354/322; 354/316
[58] Field of Search ..... 354/320, 321, 322, 316

[56] References Cited

U.S. PATENT DOCUMENTS

| | | | |
|---|---|---|---|
| 2,823,595 | 2/1958 | McFadden | 354/322 |
| 3,079,852 | 3/1963 | Little, III et al. | 354/322 |
| 3,469,517 | 9/1969 | Nishimoto | 354/322 |
| 3,610,130 | 10/1971 | Langkopf | 354/322 |
| 4,208,119 | 6/1980 | Spence-Bate et al. | 354/322 |
| 4,431,293 | 2/1984 | Riekkinen | 354/322 |
| 4,475,799 | 10/1984 | Castellarin | 354/322 |
| 4,572,639 | 2/1986 | Mackson | 354/320 |
| 4,607,930 | 8/1986 | Castellarin | 354/322 |

FOREIGN PATENT DOCUMENTS

| | | | |
|---|---|---|---|
| 1962712 | 6/1971 | Fed. Rep. of Germany . | |
| 2821648 | 11/1979 | Fed. Rep. of Germany . | |
| 371089 | 4/1932 | United Kingdom | 354/322 |

*Primary Examiner*—A. A. Mathews
*Attorney, Agent, or Firm*—Toren & McGeady

[57] ABSTRACT

An apparatus for developing and after treatment of photographic development material includes a plurality of containers arranged one after another in a row with the containers having open tops. The containers are arranged to receive different treatment fluids. A preparation station is located at the upstream end of the row of containers. A first transfer device is located above the preparation stations and a first one of the containers. The first transfer device extends over the preparation stations and the first container for moving frames holding the development material into the first container. A second transfer device is located downstream of the first transfer device for placing the frames in the downstream containers and for transferring them from one station to another. The second transfer device has a carrying element displacable in the vertical and horizontal directions and extending over the upper tops of the downstream containers.

8 Claims, 2 Drawing Sheets

APPARATUS FOR DEVELOPMENT AND AFTER-TREATMENT OF PHOTOGRAPHIC MATERIAL TO BE DEVELOPED

The present invention is directed to an apparatus for the development and after-treatment of photographic development material in a plurality of containers which are arranged one after the other in row form behind a preparation station and are open at top, serve to receive the respective treatment fluids and are protected at least partially from the incidence of light, wherein a device is assigned to these containers which serves to hold the development material and transfers frames, which can be lowered into the containers, from one station to the following station in a stepwise manner and comprises a carrying element which is located above the row of containers and is displaceable vertically as well as horizontally and is equipped with gripping devices which grip the individual frames and whose forward feed is equal to the length of a step and whose minimum lift is equal to the height of the frames to be transferred.

An apparatus of the type described in the beginning is already known e.g. from German Offenlegungsschrift 19 62 712 and 28 21 648. Also, in these previously known apparatuses a plurality of treatment containers which are open at the top are arranged one after the other in row form and a transferring device comprising a continuous carrying beam is provided, by means of which the frames which are equipped with the development material can be transferred in a stepwise manner from one container into the following container or can be transferred by one step in the respective container itself. Such a transferring device has proven extremely favorable in practice, but this transferring device is still hampered by the disadvantage that the stepwise forward feed is constant and the development time of the development material which is carried by the frames can only be adjusted in rough cyclical steps, wherein a development material with long development time blocks the apparatus for further normal development material.

It is the object of the present invention to construct an apparatus of the generic type discussed in the beginning in such a way that the development material can remain for a sufficiently long time in the first treatment container adjacent to the preparation station, also during long-term and special developments, without the normal operation of the apparatus being impaired or even completely blocked.

This object is met, according to the invention, in that a special device is assigned to the preparation station and to the first container adjacent to the latter, which first container preferably serves to receive the development fluid, which device transfers the frames equipped with the development material and is also equipped with a gripping device, the maximum forward feed of the device, which extends almost along the entire width of the preparation station and of the first container, being changeable individually in such a way that the respective frames are inserted in the treatment container in each instance at a place such that the distance from this place to the end of the treatment container corresponds precisely to the treatment time assigned to the respective development material. Thus, it is possible by means of this step, according to the invention, to insert development material having different development times into the treatment containers one after the other regardless of the sequence in which this development material is fed to the preparation station.

As regards this transferring device itself, it is advisable that it comprise a lifting mechanism and a forward feed device which cooperates with the latter and is displaceable in the horizontal direction.

In addition, in order to ensure a continuous forward feed of the frames equipped with the development material in the first treatment container independently of said transferring device, this first treatment container is advantageously equipped with its own conveying device which advances the frames, which are already lowered into the treatment fluid and equipped with the development material, in the treatment direction.

This conveying device can comprise e.g. two chains, belts or the like which are at a distance from one another and circulate in a continuous manner in the treatment direction so as to be parallel to one another; supports, bearings or the like, which cooperate in pairs at equal distances from one another, serve to receive and hold the frames to be transported, and in which the frames which are transferred into the first treatment container from the preparation station are to be deposited, are arranged at these chains, belts or the like. This device effects a forward feed of the frames toward the end of the container in either a stepwise or a continuous manner, the frames being inserted into the container one after the other in a row; at the end of the container the frames are removed from this first container after the provided development time has expired by means of the carrying element which extends along the row of the following treatment container and are transferred one after the other into the following treatment containers.

In such apparatuses, the width of each individual treatment container depends on the maximum development time and accordingly on the maximum forward feed path corresponding to this development time. However, these development times of the photographic development material can vary widely in the first treatment container, wherein extremely long development times also occur occasionally. If such a development material having an extreme development time is also to be treated a correspondingly wide treatment container is required for this purpose. However, as the width and constant depth of this treatment container increases, its volumetric capacity also increases, which in turn requires a correspondingly large quantity of development fluid. But this results not only in an increase in the overall length of the apparatus, but also in an increase in costs for the utilized development chemicals. Such expense is worthwhile in practice only with a sufficiently large quantity of a development material having such long development times. However, these conditions arise very seldom in practice. Thus, to this extent, there is the additional object within the framework of the present invention to avoid such unnecessary expense whenever possible, but to provide the possibility that development material having longer development times can also be developed in a treatment container having only a normal width.

This additional object is met, according to the invention, in that at least two supports or the like, which likewise cooperate as a pair and serve also to receive and hold one of the frames, are arranged in addition so as to be vertically adjustable in the input area of the conveying device advancing the frames equipped with the development material in the first container; the bearings of the supports lie above the forward feed path of the conveying device belonging to the first container in their raised upper work position and lie below the forward feed path of this conveying device in their lowered lower rest position in such a way that when the frames are lowered into the bearings of the raised supports they remain at this location in the treatment container, but are advanced in the provided treatment direction by the conveying device of the container when both supports are lowered into their rest positions.

Markers indicating the respective treatment time are arranged at each of the frames in order to designate the respective development time of the development material comprised in a frame; the information of the markers can be read by means of sensors located prior to the preparation station and can be transmitted to an electronic control system belonging to the device. This control system then issues a corresponding command to remove the respective frame from the preparation station and to feed it to a determined position in the first treatment container. In so doing, it is necessary that the fed frame with the respective development material remain in the first stationary position for a certain advance time; the vertically adjustable supports are thus also displaced into their raised work position by means of this control system to the extent that the conveying device belonging to this first container remains inactive at first. When these raised supports are lowered into their rest position after the allowed time has elapsed, the respective frame is taken along by the conveying device and advanced in a stepwise or continuous manner within this development container until the end of the container. As soon as the frame has reached the end of the container, it is grasped by the carrying element assigned to the following row of containers, removed from the first container and advanced to the next treatment container in order to be lowered into the latter.

Other details of the present invention follow from the description of an embodiment form shown by way of example in the drawing and from the respective claims.

Figure 1:
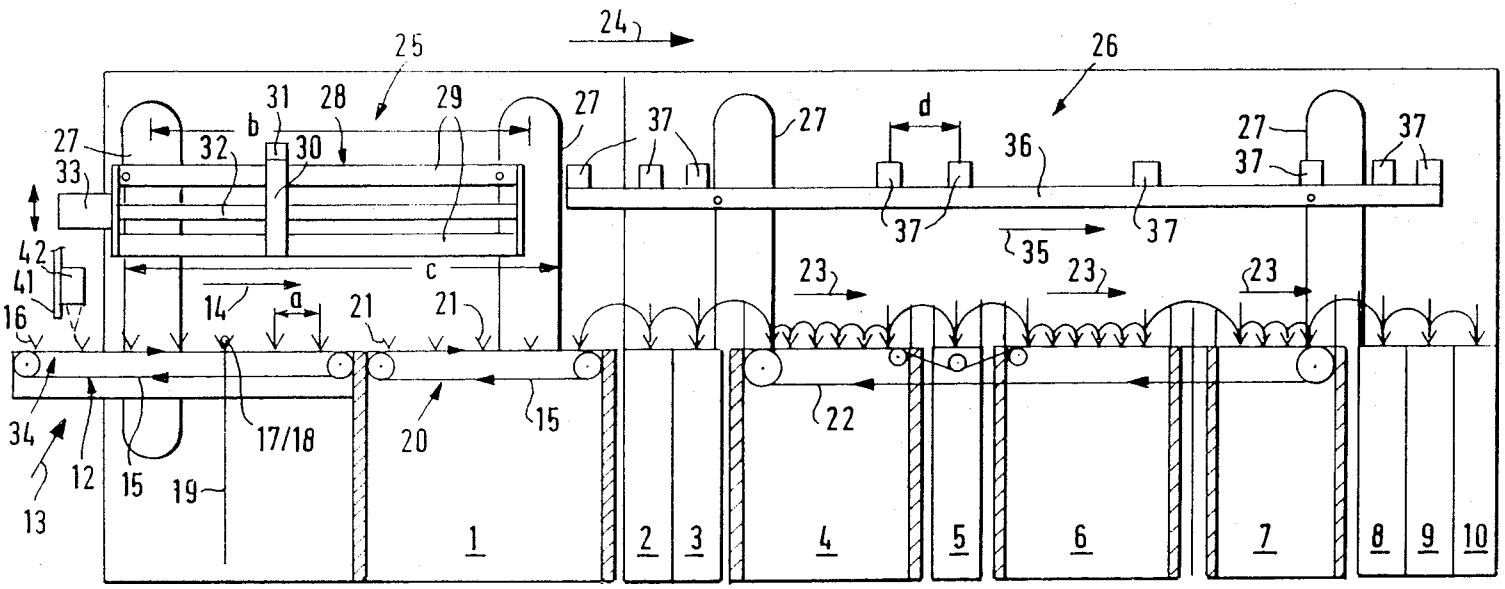
FIG. 1 shows a schematic side view of the device.

The apparatus, which is shown schematically in a side view in FIG. 1, comprises a row 11 of containers formed from the treatment containers 1 to 10 serving to receive different treatment fluids, the row 11 being placed on a frame which is not shown in particular. A preparation station 13 equipped with a forward feed device 12 is arranged prior to this row 11 of containers, wherein this forward feed device 12 comprises two conveying chains 15, belts, or the like, arranged at a distance from one another and circulating in the conveying device 14. Support bearings 16, which are open at the top and in which the two ends 17 of the upper cross beams 18 of the frames 19 equipped with the development material, not shown in particular, are to be hinged from the top, are arranged at these conveying chains 15 at a distance a in each instance.

The following first treatment container 1 serves to receive the development fluid and, like the preparation station 13, is equipped with an identical conveying device 20 whose support bearings 21, which are likewise arranged at equal distances a from one another, also serve to receive and hold the frames 19 which are lowered into the first container 1.

The two following containers 2 and 3 are provided on the one hand for receiving a water bath and on the other hand for receiving a reversing bath. On the other hand, the color development takes place in the treatment container 4, followed by the container 5 with a conditioning bath. The following containers 6 and 7 contain a bleaching bath and a fixing bath, respectively. The two containers 8 and 9 serve to receive a water bath in each instance. This row 11 of containers is terminated by the container 10 which contains a stabilizing bath.

While the fed frames 19 in the treatment containers 2, 3, 5 and 8 to 10 remain stationary only in one position, the frames 19 in the other treatment containers 4, 6 and 7 are displaced in a stepwise manner in the direction of arrows 23 by means of a joint identical conveying device 22.

In order to carry out the transfer of the frames 19 gathered in the preparation station 13 from the latter into one of the following treatment containers 1 to 10, the apparatus, according to the invention, is equipped with two transferring devices 25 and 26 arranged one behind the other in the conveying direction 24.

The transferring device 25 assigned to the preparation station 13 and to the first development tank 1 comprises two conveying chains 27 which are located at a distance b from one another and circulate in the vertical direction, a horizontal forward feed device, designated by 28, being arranged at the latter. This forward feed device 28 comprises two horizontal carrying rails 29 on which a carriage 30 can be reciprocated in the horizontal direction, the carriage 30 itself comprising in turn a gripping arm 31, which projects forward into the area of the preparation station 13 and of the first container 1, and being equipped with an electromagnetic gripping device. The displacement of this carriage 30 is effected by means of a spindle drive 32 whose motor is designated by 33. The maximum distance c of this carriage 30 stretches from the input area 34 of the preparation station 13 until the second half of the development container 1.

The second transferring device 26 is also equipped with two identical conveying chains 27 which likewise circulate in the vertical direction, a carrying beam 36, which can be reciprocated by one step d in each instance in the direction of the horizontal arrow 35, being arranged at the latter. This carrying beam 36 comprises a plurality of gripping arms 37 which project forward into the area of the containers 1 to 10 and are also equipped with an electromagnetic gripping device.

Figure 3:
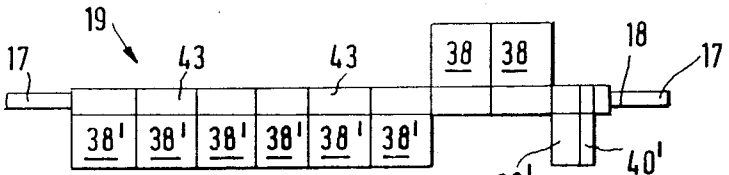
FIG. 3 shows a top view of the marker plates articulated at a frame.
Figure 2:
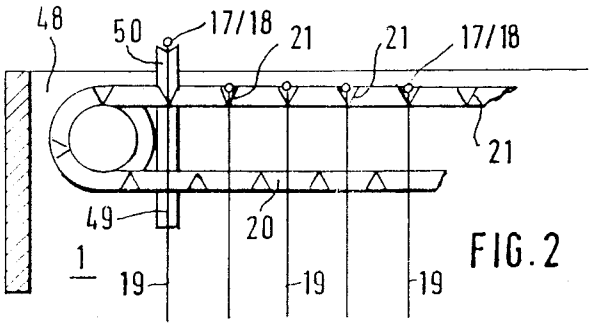
FIG. 2 shows a section from FIG. 1 in enlarged scale.

FIG. 3 shows the top view, in enlarged scale, of one of the frames 19, known per se, which serve to hold the development material and whose horizontal cross beam 18 terminates in the free cross beam ends 17 on both sides. Moreover, this cross beam 18 also serves at the same time as a carrier for plates 38 to 40, which are articulated at the latter and serve as markers for the individual development times of the development material which are to be carried out, and can be swiveled out of a vertical or also horizontal rest position into an oppositely located horizontal work position in each instance. The horizontal work positions of these plates, which are designated in FIG. 3 by 38′ to 40′, are to be read by sensors 41 which belong to an inquiry station 42 located in the input area 34 of the preparation station 13. Since the width of the plates 38 corresponds to a full minute of treatment and the width of the plate 39 corresponds to a half minute of treatment and the width of the plate 40 corresponds to a quarter minute of treatment, a treatment time of a total of 6 ¾ minutes is indicated by the plates 38', 39' and 40' which are folded over into their work positions. Of course, these plates 38 to 40 can also be graduated as desired. It is also possible to assign different treatment times to these plates 38 to 40.

The apparatus which was described in detail previously functions in the following manner: As soon as one of the frames 19 belonging to this apparatus is equipped with the provided development material, the plates 38 to 40 serving as markers are folded out of their horizontal rest position by 180° into their opposite horizontal work position. The length of the respective development time of the development material clamped in this frame 19 will determine which and how many of these plates 38/40 occupy their folded over work position. Next, this frame 19 is hinged into the two closest support bearings 16 of the two conveying chains 15 by the ends 17 of its cross beam 18 on both sides. In a further revolution of these conveying chains 15, this frame 19 is displaced, e.g. by one step a, in the conveying direction 14, wherein it passes the inquiry station 42 outfitted with the sensors 41. These sensors 41 determine which of the marker plates 38/40 have withdrawn from their folded over work position determining the development time. This information is transmitted to the control device belonging to the apparatus, which control device assigns this information to the previously interrogated frame 19.

In order to ensure that all sensors 41 operate in an orderly manner a control measurement is carried out in the area of the articulation of these plates 38/40 as to whether or not all sensors 41 also respond to the articulated sleeves 43 which lie axially and accordingly in a neutral position adjacent to one another in every plate position.

Figure 4:
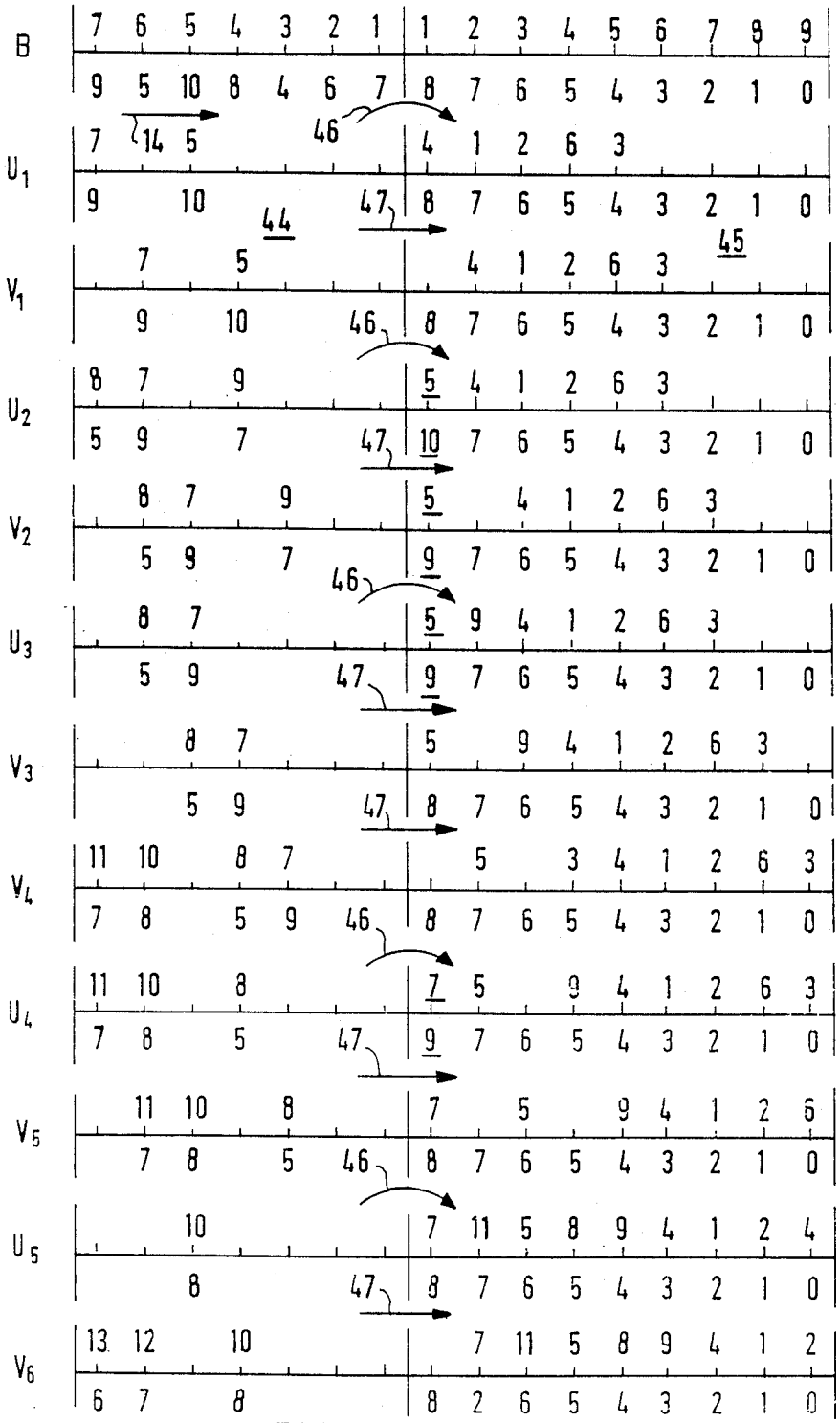
FIG. 4 shows the schematic sequence of the transferring processes.

The schematic course of the individual transferring processes and forward feeds in the area of the preparation station 13 and in the area of the first treatment container 1 is explained in the following in connection with FIG. 4. In its left-hand area 44 corresponding to the preparation station 13, the charging position B shows seven charging stations 1 to 7 located one after the other in the conveying direction 14. The right-hand area 45 of this position B, on the other hand, shows the nine charging stations 1 to 9 belonging to the conveying device 20 of the first treatment container 1 with the treatment times of 8 to 0 minutes which are assigned to the latter and indicated below them.

If seven frames 19 are hinged in the charging stations 1 to 7 of the preparation station 13, which frames 19 carry the numbers 1 to 7 and are equipped with the development material, the numbers listed below these charging stations 1 to 7 indicate in minutes the length of the treatment times assigned to these individual frames 1 to 7.

After all treatment times of the development material held by the frames 1 to 7 have been stored in the control device, the transferring 46 of these frames into the first development container 1 is subsequently effected by means of the lifting mechanism 27, wherein the respective beam ends 17 of the respective frames 19 are hinged into the support bearings 21 of the conveying device 20 belonging to the first treatment container 1. As can be seen from the position $U_1$ shown in FIG. 4, the frame 3 having the treatment time of 4 minutes is hinged into the two support bearings 21 of the conveying device 20 which correspond to this treatment time of four minutes. The same is done with the additional frames 6, 2, 1 and 4 which are hinged into the following support bearings 21 with the treatment times of 5 to 8 minutes. On the other hand, the frames 5 and 7 with the longer treatment times of 10 and 9 minutes remain in the preparation station 13.

In the course of the forward feed 47 of the conveying chains 15 of the two conveying devices 14 and 20 carried out after the first minute of treatment, the frames 19 arrive in the position which is shown in the forward feed position $V_1$, in which the frames 19 are advanced in the conveying direction 14 in each instance by a step a corresponding to a minute of treatment. The frame 3 is accordingly advanced into the position corresponding to the treatment time of 3 minutes, which also applies in a corresponding manner for the following frames 6, 2, 1 and 4. In so doing, the position corresponding to the treatment time of 8 minutes is freed.

In the course of the further transferring process $U_2$, the frame 5 with the treatment period of 10 minutes is now inserted into the position corresponding to the treatment period of 8 minutes. However, in order that the frame 5 first remains in this position during the continued forward feed 47 of the two conveying chains 15 belonging to the two conveying devices 20, two supports, designated by 49, are arranged in this input area 48 of the first treatment container 1 adjacent to the two conveying chains 15 so as to be vertically adjustable; the bearings 50 of these supports are located above the two conveying chains 15 in the raised supporting position, but are located below these two conveying chains 15 in their lowered rest position. In this case, these two supports 49 are displaced into their upper working and supporting position already prior to the transferring of this frame 5. This special stationary support of the frame 5 is illustrated in position $U_2$ by means of the underlining of number 5.

In the meantime, the additional frames 8 and 9 with the assigned treatment times of 5 and 7 minutes have been hinged arbitrarily into the free positions of the preparation station 13. In the course of the forward feed $V_2$ taking place in a stepwise manner after an additional minute of treatment, all frames 1 to 4 and 6 to 9 are advanced by an additional step a corresponding to the treatment period of 1 minute. As a result of the raised supporting of the frame 5, however, the latter remains in its previous position. But the remaining treatment period of this frame 5 amounts to only 9 minutes at this point in time.

Since the position corresponding to the treatment period of 7 minutes is freed during the forward feed $V_2$, the frame 9 with the treatment period of 7 minutes can be transferred into this position according to the transferring position $U_3$ indicated in the following.

The additional forward feed $V_3$, in which the frames 1 to 4 and 6 to 8 are advanced again by a step a, is effected subsequent to this. On the other hand, the frame 5 continues to remain in its previous position. However, since the treatment time of this frame 5 has been reduced to 8 minutes in the meantime, the previously raised supports 49 and their bearings 50 are lowered into their rest position by means of the control device, so that the beam ends 17 of this frame 5 are now lowered into the support bearings 21 of the conveying chains 15 corresponding to this position and come to rest in the latter.

Since only the position corresponding to a treatment period of 7 minutes is freed during this forward feed $V_3$, but the frames 8 and 7 remaining in the preparation station 13 require a treatment time of 5 and 9 minutes, respectively, no further transferring of these frames 8 and 7 is possible now. After an additional minute of treatment has expired, an additional forward feed $V_4$ of all frames 1 to 9 is carried out, wherein the frame 5 has also participated in this forward feed $V_4$ and has been advanced into the position corresponding to the treatment time of 7 minutes. Moreover, the additional frames 10 and 11 with the treatment times of 8 and 7 minutes have also been inserted into the preparation station in the meantime.

The treatment time of 4 minutes assigned to the frame 3 has elapsed in the meantime, so that this frame 3 can subsequently be taken over by the carrying beam 36 of the second transferring device 26 and can be transferred into the second treatment container 2 serving as water bath.

In the following transferring process $U_4$, the frame 7 with the treatment time of 9 minutes is now inserted into the position freed during the forward feed $V_4$. Since the treatment time of 9 minutes first excludes an additional forward feed of the frame 7, this frame 7 is hinged in the supports 49 which again occupy their raised position in the manner already discussed previously. Since no suitable frame is available for the position corresponding to the treatment time of 6 minutes, the frames 8, 10 and 11 remain in their additional waiting position.

The following forward feed $V_5$ again advances the frames 1, 2, 4 to 6 and 8 to 11 by a step a. The frame 7, on the other hand, remains in its previous position, wherein the two supports 49 are lowered again into their rest position as a result of the remaining treatment time of 8 minutes.

After the positions corresponding to the treatment times of 5 and 7 minutes have become free by means of the forward feed $V_5$, the frames 8 and 11 can be transferred into these positions during the following transferring process $U_5$. The frame 6, on the other hand, is transferred from its position 0 into the following treatment container 2 by means of the carrying beam 36 of the second transferring device 26.

The additional forward feed $V_6$, in which the frames 1, 2, 4 and 5 and 7 to 10 in turn cover an additional step a, is effected subsequently. Moreover, the additional frames 12 and 13 with the respective treatment times of 7 and 6 minutes have been inserted into the preparation station 13 in addition. Since the first position corresponding to the treatment period of 8 minutes has been freed in the course of this forward feed $V_6$, the frame 10 can now be brought into this position in the following transferring process which is no longer shown in particular. The continued process of the subsequent forward feeds and transferring processes is analogous and requires no further discussion.

In summary, it is ensured that the various treatment positions of the first development container are made use of in a particularly favorable manner by means of this special type of control of the apparatus and with the aid of the individually adjustable forward feed of the first forward feed device 25, and treatment times requiring a treatment time of more than 8 minutes can also be carried out.

If the forward feed of the two conveyor chains 15 is not effected in a stepwise manner, but is implemented in a continuous manner, the individual frames 19 can also be transferred in such a way that they remain in the first treatment container 1 not only for the duration of full minutes, but also for the duration of corresponding intermediate periods. For example, if a frame 19 is to be treated during a time period of 6 minutes and 45 seconds, this frame 19 is to be inserted into the treatment container 1 in the corresponding position at the point in time between the two treatment times of 6 and 7 at which the two respective support bearings 21 of the two conveying chains 15 precisely occupy this position and are accordingly ready to receive the beam ends ;7 of this frame 19.

In this case, for the treatment time of a total of 6 minutes and 45 seconds, six of the plates 38 are to be folded over into their work position at the frame 19 in the manner already shown in FIG. 3 for the six minutes, as are plate 39 for 30 seconds and plate 40 for another 15 seconds, so that the control of this process can also be effected by means of the control device.

I claim:

1. Apparatus for developing and after-treatment of photographic development material in a plurality of containers arranged one after another in a row and having open tops, said row extending in a transfer direction and having a number of stations spaced apart in the transfer direction, said containers arranged to receive treatment fluids and protected at least partially from the incidence of light, a first transfer device located above a first one of said containers and having a dimension extending in the transfer direction, said container is arranged to receive a developing fluid, said first container having an upstream end and a downstream end in the transfer direction and said first transfer device is arranged to insert frames in said first container at individually variable locations spaced from the downstream end, said first transfer device extending in the transfer direction at the most approximately across the corresponding dimension of the first container, a second transfer device downstream from the first transfer device in the transfer direction and being lowerable into the containers in steps for transferring the frames from one station to another downstream station, said second transfer device arranged to hold a plurality of the frames in a number of the downstream containers, said second transfer device comprises a carrying element displaceable vertically and horizontally and located above the open tops of the containers, said carrying element is equipped with means for gripping the individual ones of the frames and having a horizontal advance equal to an incremental dimension of the transfer direction dimension thereof and a minimum stoke in the vertical direction equal to the height of the frames, wherein the improvement comprises a preparation station located at the upstream end of the first container and said first transfer device extends approximately across the preparation station in the transfer direction.

2. Apparatus, as set forth in claim 1, wherein the first transfer device comprises a lifting mechanism and a carriage reciprocal in the transfer direction and cooperating with said lifting mechanism.

3. Apparatus, as set forth in claims 1 or 2 where the first container has a conveying device therein for advancing the frames in the transfer direction within said first container in one of a stepwise and continuous manner.

4. Apparatus, as set forth in claim 3, wherein said conveying device comprises two endless belt-like members extending in the transfer direction and spaced laterally from and parallel to one another, supports arranged on said belt-like members and cooperating in pairs at equal distances apart and arranged to receive and hold frames to be moved in the transfer direction.

5. Apparatus, as set forth in claim 4, wherein at least two support-like members are located opposite one another transversely of the transfer direction and cooperating as a pair to receive and hold one of the frames, said support-like members are vertically adjustable in an input area of the conveying device, said support-like members having bearings thereon arranged to be located above a forward feedpath of the conveying device in an upper work position and below the forward feedpath in a lower rest position.

6. Apparatus, as set forth in claim 1, wherein marker plates, are located on said frames indicating the treatment time of the developmental material secured thereto, sensors located upstream of the preparation station are arranged to read said marker plates and for transmitting a signal to an electronic control device associated with the apparatus.

7. Apparatus, as set forth in claim 6, wherein said marker plates, are displaceable about a horizontal axis of an associated said frame and are arranged to be displaced between a rest position and a work position about said horizontal axis.

8. Apparatus, as set forth in claim 7, wherein said sensors read said markers in the work position and subsequently carry out a control measurement in a neutral area.

* * * * *